US006679403B2

(12) United States Patent
Goodall et al.

(10) Patent No.: US 6,679,403 B2
(45) Date of Patent: Jan. 20, 2004

(54) DISPENSING DEVICE FOR DISPENSING LIQUID FROM A CONTAINER

(76) Inventors: Donald Terry Goodall, 30 Beach Street, Blakehurst, NSW 2221 (AU); Harvey Mckenzie Milne, 22 The Circle, Avalon, NSW 2107 (AU)

( * ) Notice: Subject to any disclaimer, the term of this patent is extended or adjusted under 35 U.S.C. 154(b) by 0 days.

(21) Appl. No.: 10/092,575

(22) Filed: Mar. 8, 2002

(65) Prior Publication Data

US 2002/0092876 A1 Jul. 18, 2002

Related U.S. Application Data

(63) Continuation-in-part of application No. PCT/AU00/01155, filed on Sep. 22, 2000.

(30) Foreign Application Priority Data

Sep. 22, 1999 (AU) ..... PQ3018
Mar. 9, 2001 (AU) ..... PR3636

(51) Int. Cl.[7] ..... B67D 3/00
(52) U.S. Cl. ..... 222/481.5; 222/153.06; 222/556
(58) Field of Search ..... 222/153.06, 481.5, 222/546, 556

(56) References Cited

U.S. PATENT DOCUMENTS 3,655,102 A * 4/1972 Moran ..... 222/484
4,170,315 A * 10/1979 Dubach et al. ..... 220/281
4,487,342 A * 12/1984 Shy ..... 222/481.5
4,711,372 A * 12/1987 Gach ..... 222/23
4,795,044 A * 1/1989 Beck ..... 215/237
4,852,770 A * 8/1989 Sledge et al. ..... 222/153.14
5,261,575 A * 11/1993 Keller ..... 222/455
5,579,957 A * 12/1996 Gentile et al. ..... 222/153.14
5,961,001 A 10/1999 Davis et al. ..... 222/153.06
6,041,953 A 3/2000 Goodall ..... 215/354
6,439,433 B1 * 8/2002 Dubach et al. ..... 222/145.3

FOREIGN PATENT DOCUMENTS

| | | |
|---|---|---|
| AU | 542683 | 9/1981 |
| AU | 624588 | 6/1989 |
| EP | 0 446 991 | 9/1991 |
| GB | 2 333 288 | 7/1999 |
| JP | 10-338261 | 12/1998 |

* cited by examiner

*Primary Examiner*—Joseph A. Kaufman
(74) *Attorney, Agent, or Firm*—Steptoe & Johnson LLP; D. Douglas Price

(57) ABSTRACT

A dispensing device for dispensing liquid from a container, the dispensing device including a main body which includes an end wall having an internal side face directed towards the interior of the container and an external side face, a dispensing outlet, and a closure moveable relative to the main body between open and closed positions to selectively open and close the dispensing outlet, a chamber between the external side face and the dispensing outlet, a liquid transfer port in the main body for permitting liquid flow from the container interior to the chamber and a breather port in the main body providing communication between the container interior and the chamber, the liquid transfer port and the breather port being spaced apart from one another so as to form a static head therebetween.

15 Claims, 10 Drawing Sheets

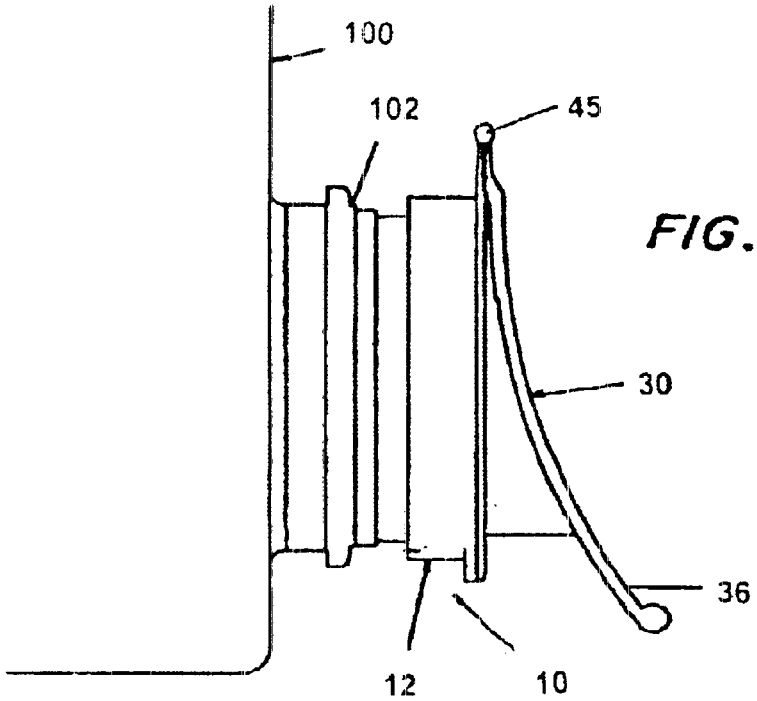
FIG. 2
FIG. 3
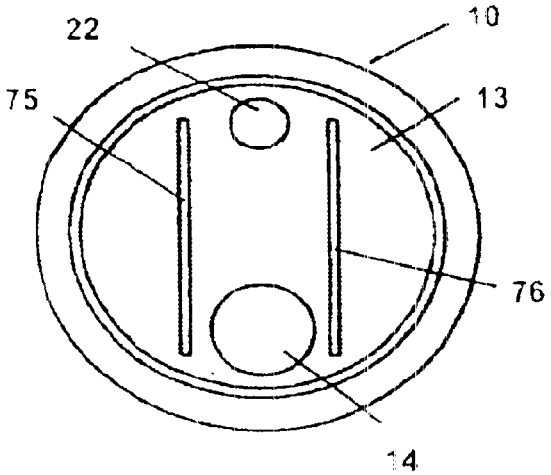
FIG. 4
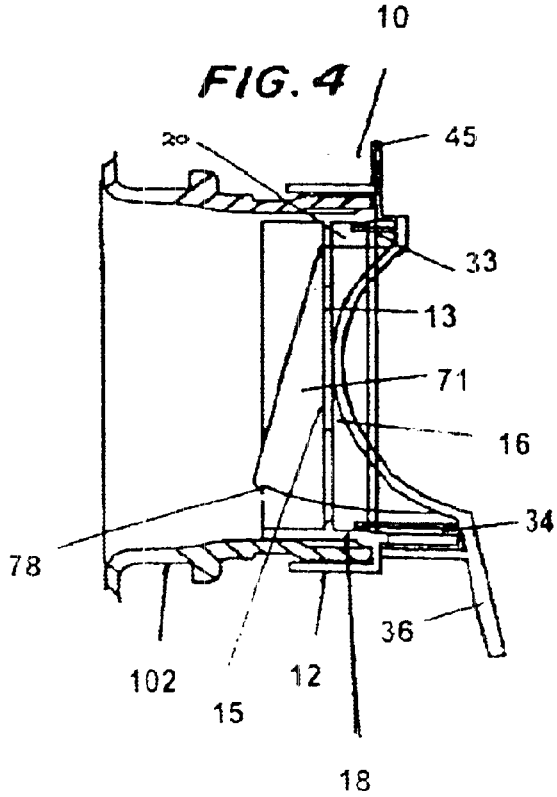

DISPENSING DEVICE FOR DISPENSING LIQUID FROM A CONTAINER

This is a continuation-in-part application of International Application No. PCT/AU00/01155, filed Sep. 22, 2000, and published under PCT Article 21(2) in English as International Publication No. WO 01/21524 on March 29, 2000.

This invention relates generally to dispensing devices suitable for dispensing liquids from containers.

BACKGROUND OF THE INVETION

One example of a type of container with which the dispensing device of the present invention is particularly suitable for use are containers of the type for dispensing liquids such as drinking water, juice and the like. Typically such containers are located on a bench or in a refrigerator and have a discharge tap in a region near the base of the container. To ensure smooth discharge of the liquid from the container it is necessary that the interior of the container is vented to atmosphere. Presently this is effected by piercing the container wall in the region of the top. Such an arrangement is not particularly satisfactory.

SUMMARY OF THE INVENTION

It is an object of the present invention to provide an improved dispensing device which alleviates the aforementioned problem.

According to one aspect of the present invention, there is provided a dispensing device for dispensing liquid from a container, the dispensing device including a main body which includes an end wall having an internal side face directed towards the interior of the container and an external side face, a dispensing outlet, and a closure moveable relative to the main body between open and closed positions to selectively open and close the dispensing outlet, a chamber between tie external side face and the dispensing outlet, a liquid transfer port in the main body for permitting liquid flow from the container interior to the chamber and a breather port in the main body providing communication between the container interior and the chamber, the liquid transfer port and the breather port being separate and spaced apart from one another with the breather port being disposed above the liquid transfer port when in a dispensing orientation so as to form a static head pressure differential therebetween, the spacing between the breather port and the liquid transfer port together with the chamber being such as to provide for a continuous and controlled flow of liquid from the dispensing outlet.

Preferably, the cross-sectional dimension of the liquid transfer port is greater than the cross-sectional dimension of the breather port.

The arrangement is such that when the closure of the device is opened air is introduced to the chamber. A static head differential has been created by the vertical distance between the liquid transfer port and the breather port in the main body. There are no material barriers separating the air from the liquid within the chamber. The arrangement is such that air can enter the chamber externally of the container and pass through the breather port to the interior of the container so as to ensure a continuous flow of liquid out of the container. Pressure within the container is decreased and simultaneously liquid continuously discharges through the outlet port in the bottom of the chamber wall, whilst the closure remains open.

Discharge flow rates can be adjusted to container capacities by increasing the diameter of the chamber, and/or increasing the distance of the end wall from the closure and/or the size and position of the liquid transfer and breather ports in the end wall or side wall of the main body.

Preferably, the main body includes a generally tubular side wall extending from the external side face of the end wall, such that the end wall and at least part of the tubular side wall define the chamber.

Preferably, the closure can close the open end of the tubular side wall.

The dispensing outlet is preferably in the tubular side wall. Preferably the tubular side wall is extended in the region of the dispensing outlet so as to form a gutter which directs liquid within the chamber towards the dispensing outlet.

Preferably, the closure is pivotally connected to the main body for movement between the open and closed positions.

The dispensing device may include one or more pins on one of either the main body or closure arranged to cooperate with respective one or more guides on either the main body or closure to guide the closure during pivotal movement thereof.

The device may further include flow control members which form a zone within the chamber containing the liquid transfer port and breather port. Preferably, the flow control members includes two generally parallel spaced apart partition walls which project from the closure and are receivable in slots in the end wall of the main body so as to form a conduit within the chamber which contains the liquid transfer port and the breather port.

According to one preferred form of the present invention there is farther provided a flow control member associated with the liquid transfer port, the flow control member extending into the chamber and includes a wall adjacent to and above the liquid transfer port in the dispensing orientation.

In one preferred form the flow control member includes a curved side wall which is generally semi-circular in shape and an end wall. The curved side wall extends from the end wall of the dispensing device and overlies the liquid transfer port. The side wall is open at its underside which faces towards the dispensing outlet.

The arrangement is such that in use the flow control member directs flow from the liquid transfer port towards the dispensing outlet and liquid within the chamber is directed around the curved side wall before flowing to the dispensing outlet. The position and configuration of the flow control member tends to smooth liquid flow at discharge.

The general structure of the other parts of the dispensing device may be as described above and in the aforementioned International patent specification.

The device may further include means for limiting the pivotal movement of the closure relative to the main body of the device between the open and closed positions of the dispensing outlet. The limiting means may be in the form of a pair of pins on one of either the closure or main body of the device which in use are received within respective co-operating guides on the other of either the closure or main body. Each pin has a catch section thereon which engages with a stop of the guides to limit travel of the closure relative to the main body.

The device may further include a safety catch operable to releasably retain the closure in the closed position.

In one form the safety catch may include a resilient latch member on one of the closure or the main body adapted to cooperate with a detent on the other of the closure or the main body, the arrangement being such deformation of the latch member causes it to release from the detent. Preferably, the latch member is on the closure and the detent on the main body of the device.

The latch member may be operatively connected to or forming part of the closure and includes a locking lug extending therefrom the lug including a barb or projection thereon which cooperates with the detent.

Preferably, the latch member can be deformed by digital pressure thereby releasing the lug from the detent.

According to another aspect of the present invention there is provided a tamper evidence element which includes a tear strip which prior to use connects the closure to the main body arid after removal permits the closure to move between its open and closed positions.

Preferably the dispensing device is a one piece unit which may be formed from plastics material and may be manufactured by a moulding process.

Preferred embodiments of the invention will hereinafter be described with reference to the accompanying drawings and in those drawings:

BRIEF DESCRIPTION OF THE SEVERAL VIEWS OF THE DRAWING

FIG. 2 is a side elevation of the device in a closed position;

FIG. 3 is an end view of the device;

FIG. 4 is a sectional side elevation of the device in a closed position;

DETAILED DESCRIPTION OF THE INVENTION

Figure 1:
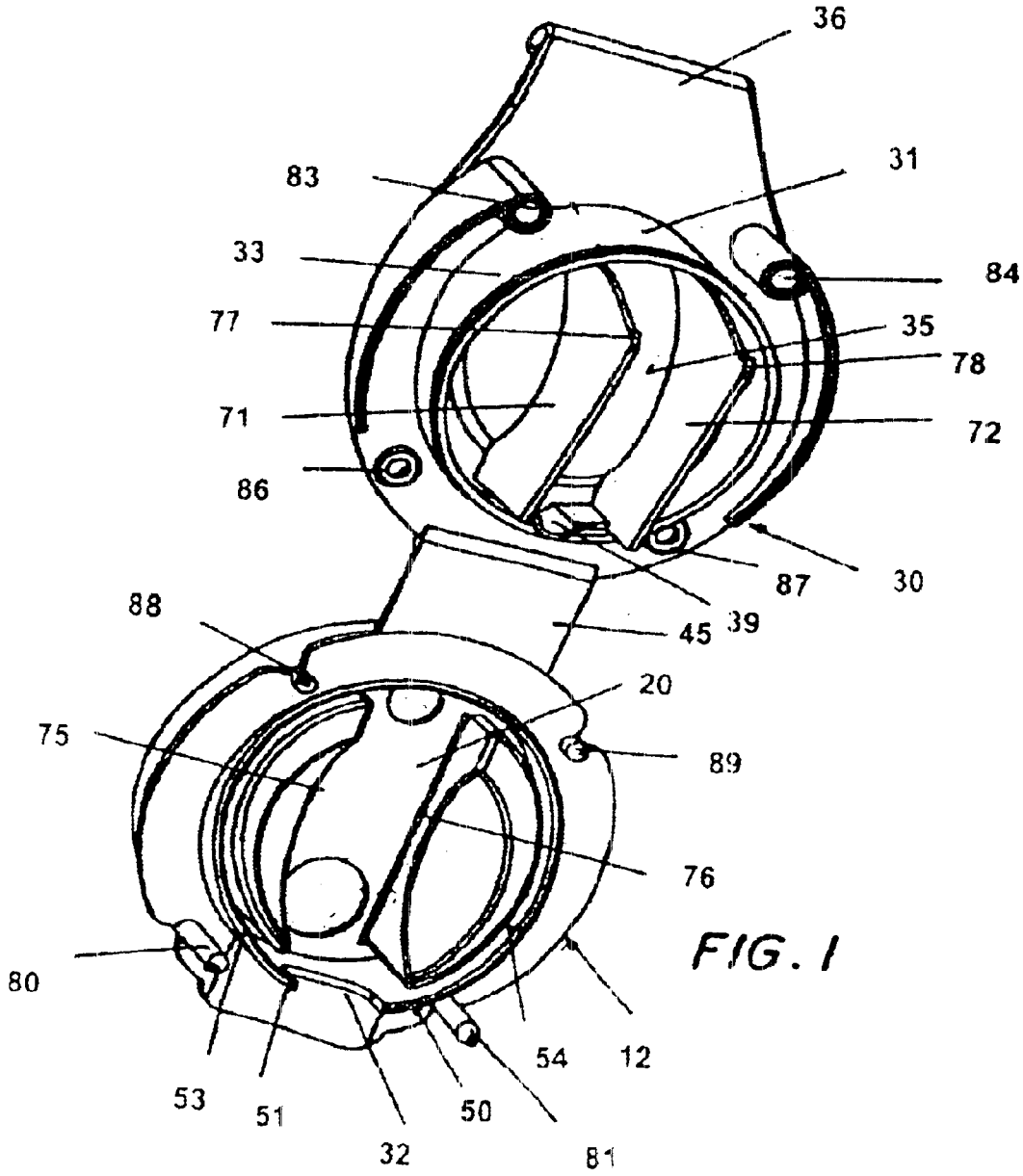
FIG. 1 is a schematic pictorial view of a dispensing device according to a preferred embodiment of the present invention showing various components thereof.

Referring to FIGS. 1 to 4 of the drawings there is shown a dispensing device generally indicated at 10 which is fitted to a container 100 having an outlet 102 (see FIG. 2) In its normal in use orientation when dispensing liquids the outlet is disposed in the region of the lower part of the container. For example, the container 100 may be in the form of a bottle which, when in a dispensing position, is rested on its side with the outlet 102 being arranged adjacent the surface on which the bottle rests. Such bottles are often used for storing and dispensing drinking water.

The dispensing device 10 includes a main body portion 12 having an end wall 13 with an internal side 15 which faces the interior of the container 80 and an external side 16. As shown the main body 12 also includes a tubular side wall section 18 extending from the end wall 13 the space adjacent the end wall and bounded by parts of the wall of the tubular side wall section defining a chamber 20. A liquid transfer port 14 and a breather port 22 are formed in the end wall 13. As can be seen from the drawings the ports 14 and 22 are spaced apart so as to produce static head pressure there between.

The chamber 20 is disposed on the external side of the end wall of the main body 12 and receives therein liquid from the liquid transfer port 14. The device further includes a closure member 30 for opening and closing a dispensing outlet 32 which is in liquid communication with the chamber 20. The closure member 30 is adapted to close the dispensing outlet 32 as a result of pivotal movement relative to the main body portion 12. The closure member 30 includes a plug section 31 having an inner end face 35 which is receivable within the tubular section of the main body so as to enclose the chamber 20, the plug section 31 being movable so as to cause the dispensing outlet 32 to open and close. As shown the plug section 30 is hingedly connected to the main body at hinge 45. A lever 36 operatively connected to the plug section is provided for opening and closing the closure member. In the embodiment shown in FIGS. 1 to 4, when the closure member 30 is in the closed position the inner end face 35 of the plug section 31 is in contact with external side 16 of end wall 13. Preferably, the plug section has sealing rings 34 on its outer surface providing a seal against the inner surface of the tubular side wall section 18 of the main body 12.

A gutter wall 50 is provided which is an extension of the tubular section. The gutter wall 50 includes a lower most portion 51 having the dispensing outlet 32 therein and two side wall portions 53 and 54 which extend to each side of the outlet. As shown the gutter wall 50 is an extension of the tubular section, the side wall portions 53 and 54 being tapered outwardly from a position near the top of the tubular section when it is in its normal operating orientation so that the gutter wall is at its widest in the region of lower most portion 51 The side wall portions 53 and 54 are adapted to act as gutters directing fluid towards the discharge outlet 32.

The device further includes liquid flow control elements in the form of parallel spaced apart partition walls 71 and 72 which project from the inner end face 35 of the plug section of the closure member 30. The partition walls 71 and 72 are receivable within slots 75 and 76 so as to form a confined region within the chamber 20 which contains the liquid transfer port 14 and breather port 22. During opening and closing of the dispensing outlet by pivotal movement of the closure member 30 the partition walls 71 and 72 can move through the slots 75 and 76 The device further includes means for limiting the pivotal movement of the closure member 30 relative to the main body 12. The limiting means includes a pair of stops 77 and 78 on the edge of the partition walls 71 and 72. A deflector 39 is arranged to direct liquid towards the outlet 32.

The device further includes a pair of catch pins 80 and 81 each penetrating respective opening 83 and 84 in the closure member 30. Each opening includes a conical tube which guides the pins 80 and 81 into position when the closure member is returned to the closed position.

The device further includes tamper evidence rings 86 and 87 and cooperating catch pins 88 and 89 interconnected by break out tabs which are caused to break when the closure member 30 is moved to the open position for the first time. The rings are retained by the pins when broken away.

Figure 5:
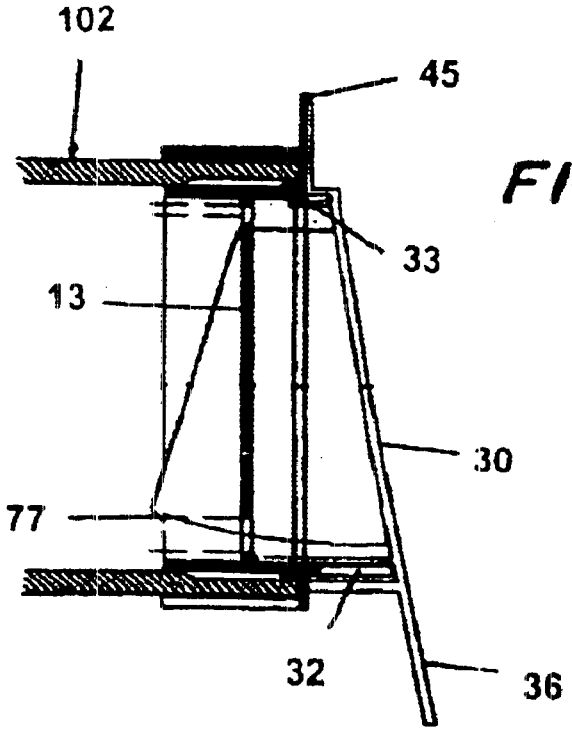
FIGS. 5 and 6 are sectional side views of the device in the open and closed positions.
Figure 6:
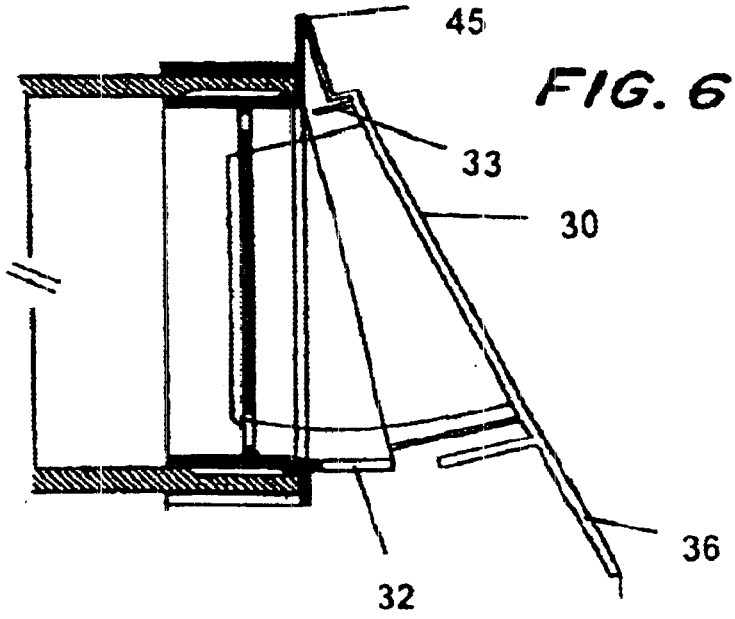

FIGS. 5 and 6 are simplified sectional side views showing the device in its closed and open positions. In the closed position as shown in FIG. 5 the plug section 33 overlies the dispensing outlet 32. By finger manipulation of the lever 36 the closure 30 can be pulled outwardly thereby pivoting about hinge 45 so that the tubular section 33 is clear of the dispensing outlet 32. The closure is arranged for pivotal movement through about 15°. Pivotal movement is limited by stops 77 and 78 which as the partition walls 71 and 72 move through slots 75 and 76 are prevented from moving beyond that shown in FIG. 6 as a result of stops 77 and 78 abutting against end wall 13 in the region just below the slots 75 and 76.

Figure 9:
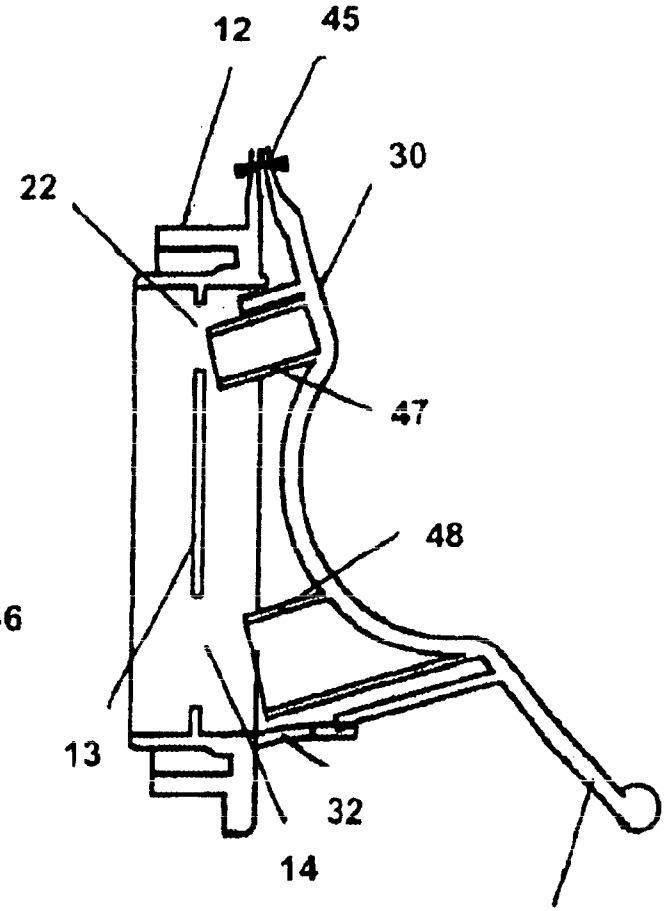
FIGS. 7 to 9 are sectional side views showing another form of device according to the invention.
Figure 8:
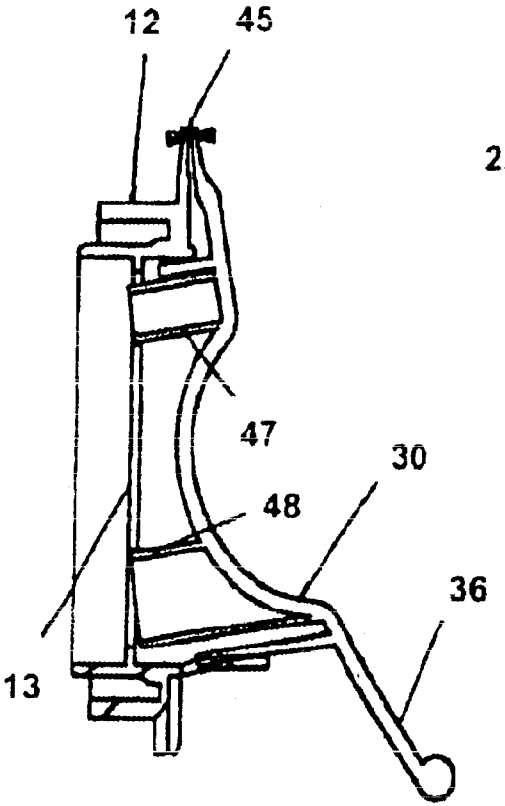
Figure 7:
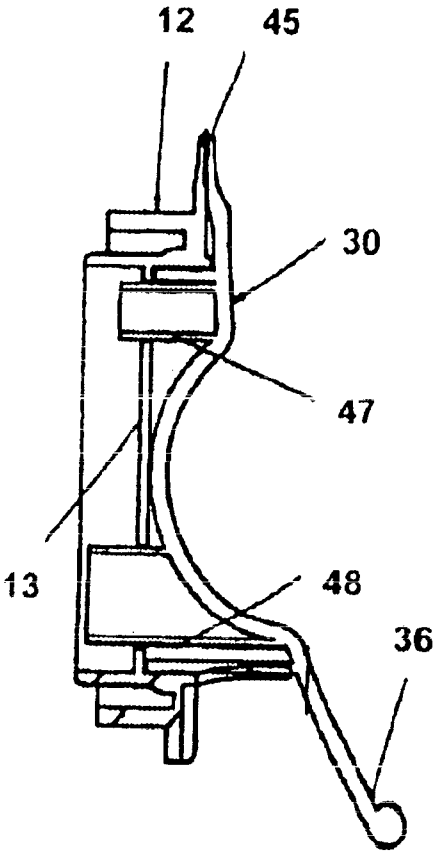

FIGS. 7 to 9 show a further embodiment and the same reference numerals have been used to identify similar parts to those described in the first embodiment. In this particular embodiment, the inner face of the wall of the closure 30 are provided with tubular projections 47 and 48 which are received within the ports 14 and 22 when the closure is in the closed position.

Figure 10:
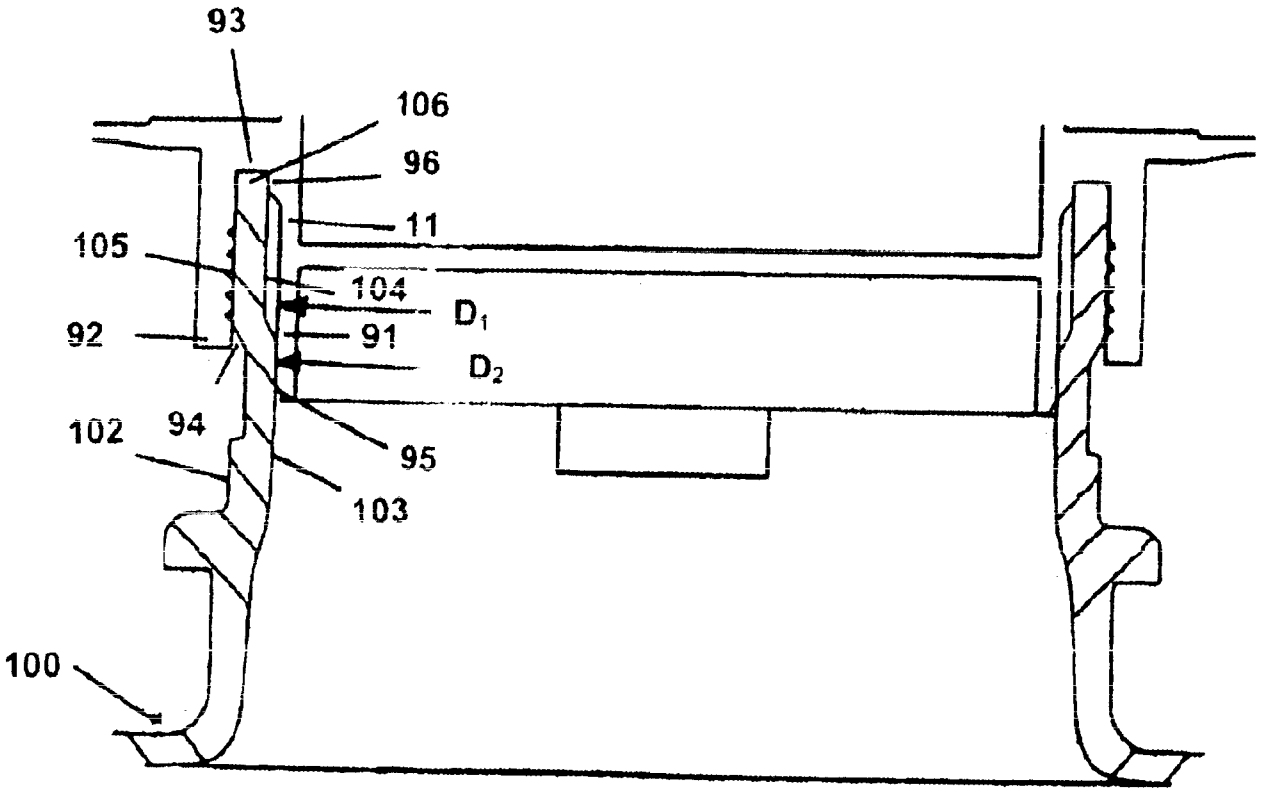
FIG. 10 is a sectional side view illustrating the manner of connection of the device to a container.

Referring to FIG. 10 of the drawings, the container 100 has an outlet 102 formed by a wall 103 with inner and outer surfaces 104 and 105 terminating in a rim at the free end thereof.

The dispensing device has an inner and outer skirt 91 and 92 connected at an upper end thereof with an end wall 93 connecting the skirts 91 and 92. The inner and outer skirts define between then a circumferential slot 94 which when the device is applied to the container, receives the container outlet 102. The inner skirt includes a section 95 at its free end defining a deflecting section.

The outer surface of the inner skirt 11 is stepped outwardly adjacent the end wall 93 to provide a sealing section or band 96. The relative diameters of the container, the inner and outer skirts and the thickness of the container wall is such that then the device is applied to the container 100 with the inner skirt 91 in contact with the inner wall and the device seated on the container rim, the inner wall of the container adjacent the sealing band is forced inwardly into tight sealing engagement with the wall thereby effectively sealing the closure to the container. The sealing section 1 and deflecting section 2 project from the outer surface of the inner skirt thereby forming a recess therebetween.

When the device is first applied to the container, the deflecting section 2 engages the inner surface of the container, because diameter $D_1$ (that is, the diameter of the outer side of skirt 91) is greater than diameter $D_2$ (that is, the diameter of the inner surface of the container outlet 102) The section 95 causes the wall the distort so that the free end wall is urged inwardly. This concept is described in Australian Patent Specification Nos. 51379/96 and 56460/98.

Figure 11:
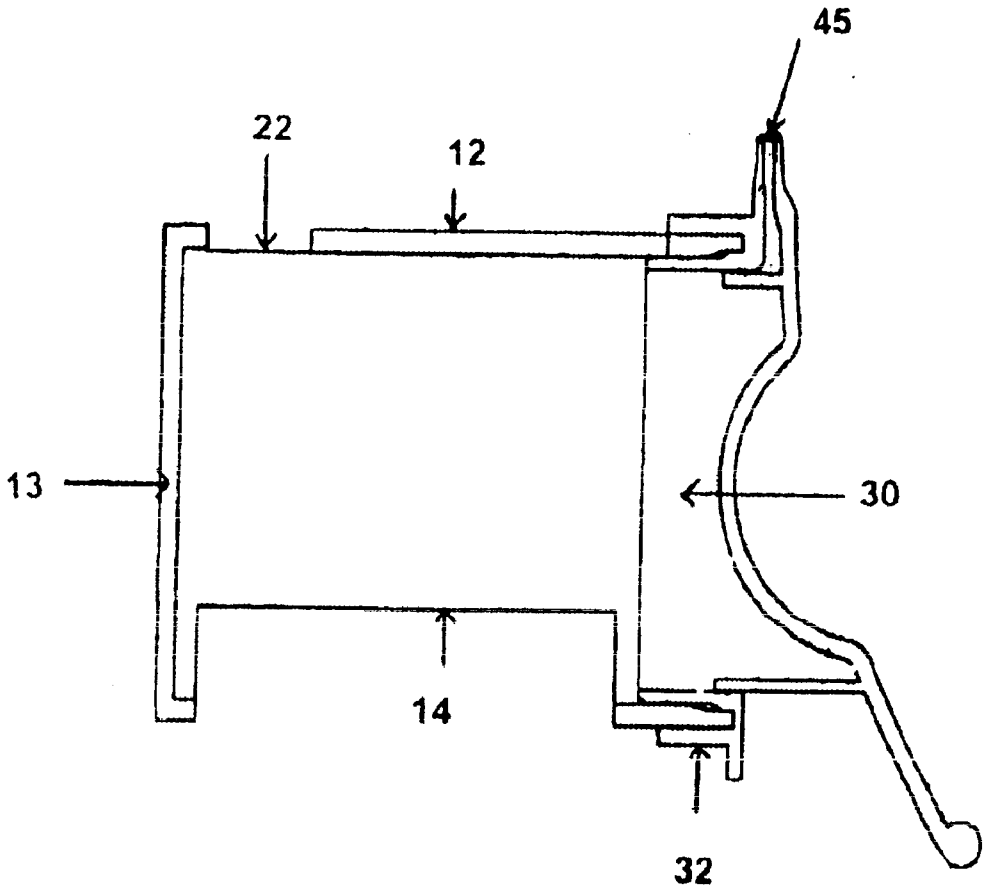
FIG. 11 is a sectional schematic side elevation of a further embodiment of device according to the invention.
Figure 12:
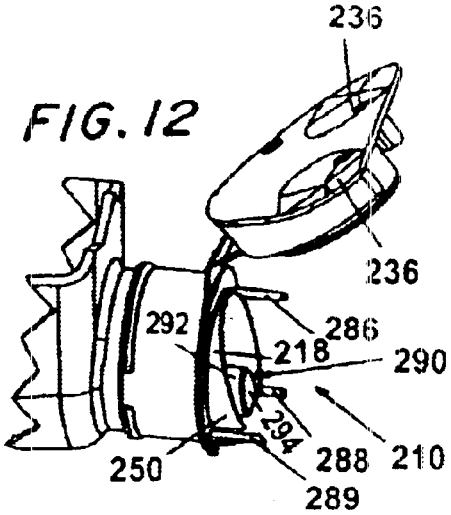
FIGS. 12 and 13 are schematic views of a dispensing device according to a further embodiment of the present invention with the closure shown in a fully open position to more clearly show various features of the device.
Figure 13:
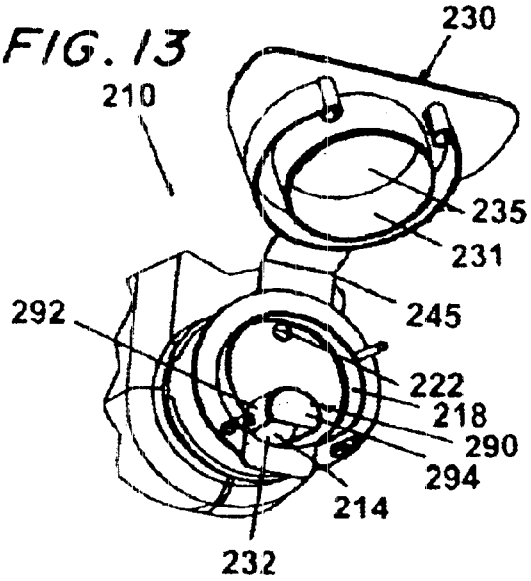
Figure 14:
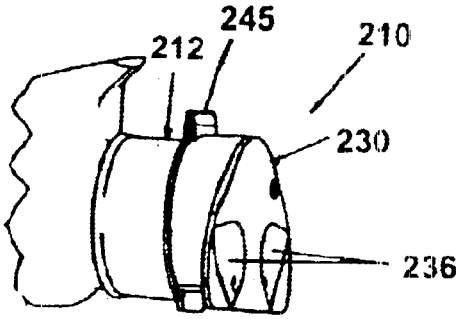
FIGS. 14 and 15 are schematic side views of the device shown in FIGS. 12 and 13 in the normal operating open closed positions.
Figure 15:
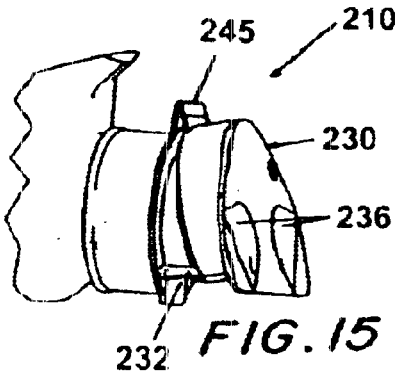
Figure 16:
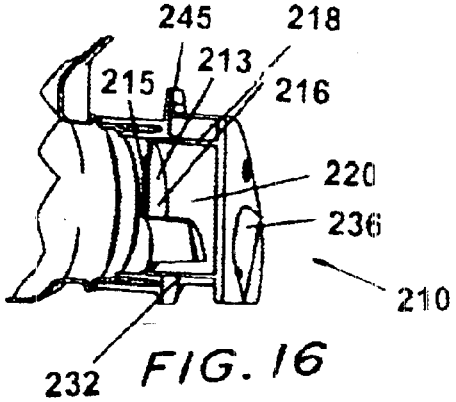
FIGS. 16 and 17 are schematic sectional side elevations similar to the views of FIGS. 14 and 15.
Figure 17:
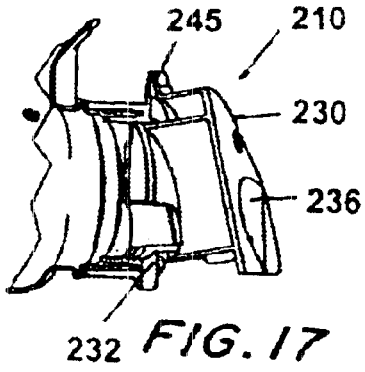
Figure 18:
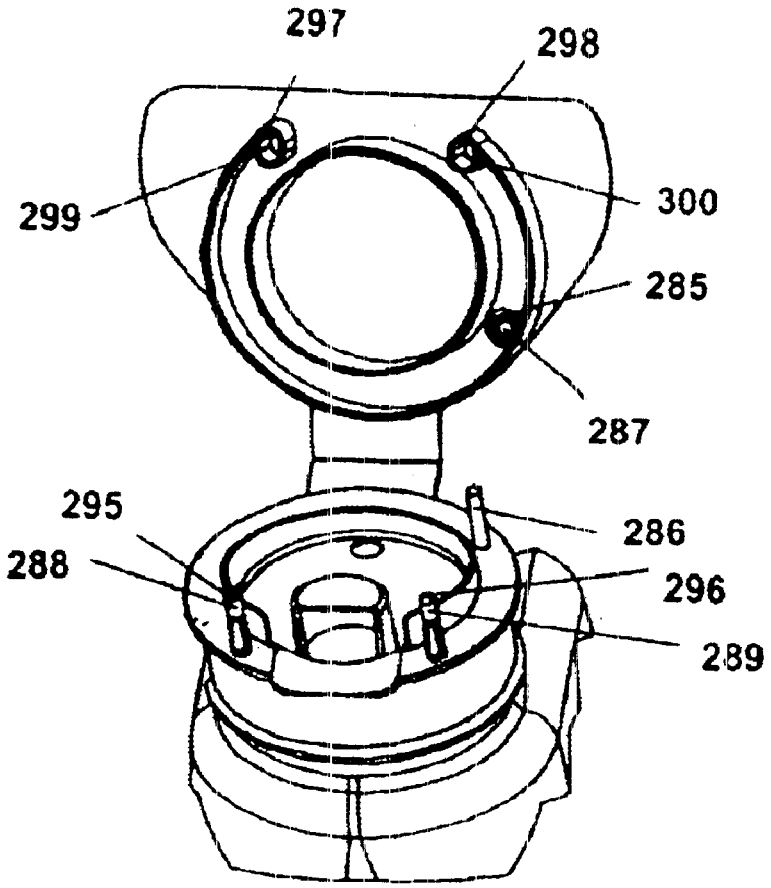
FIGS. 18 to 21 are views for more clearly illustrating other features of the device.
Figure 19:
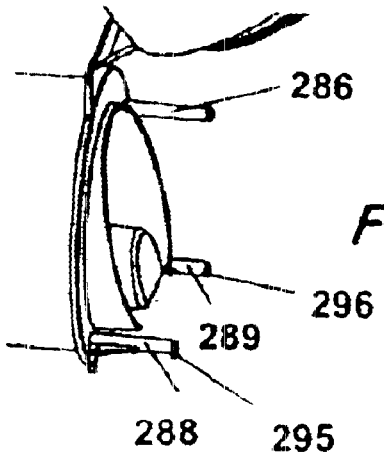
Figure 21:
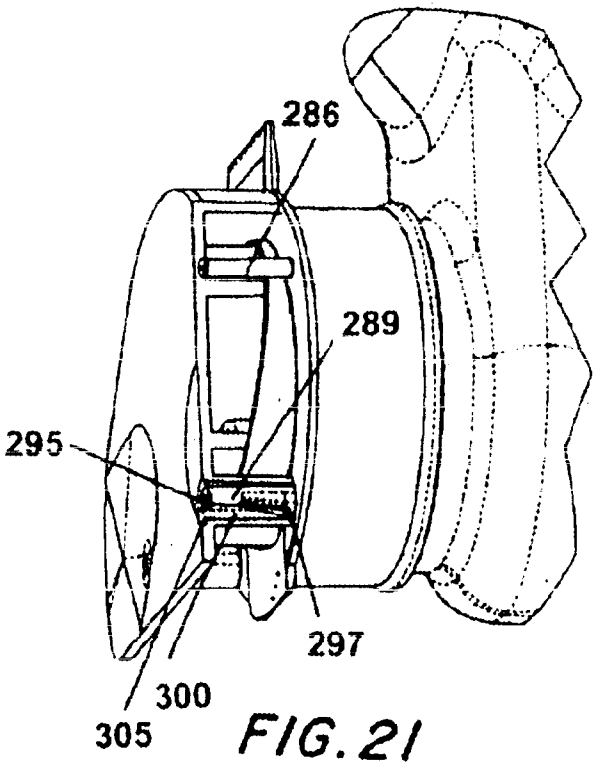
Figure 20:
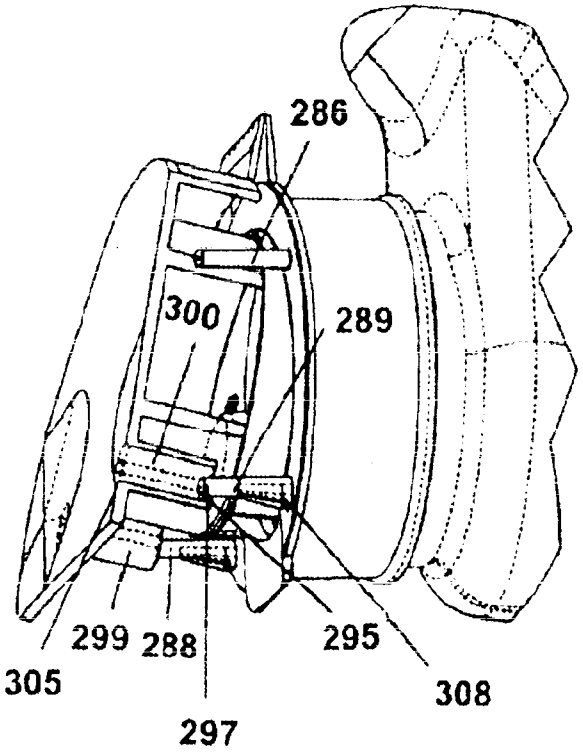
Figure 22:
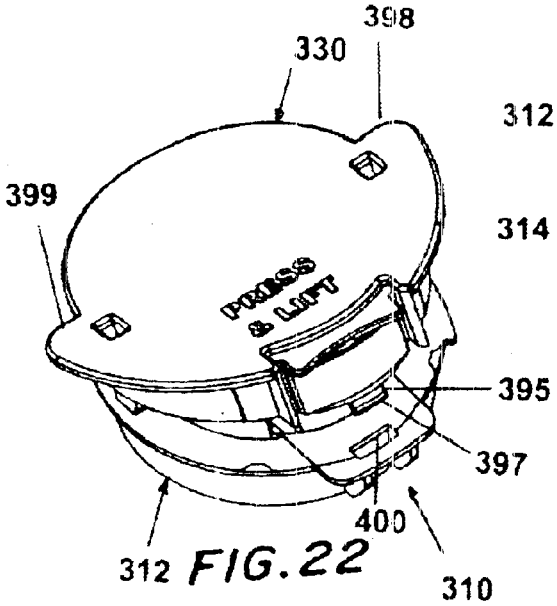
FIG. 22 is a schematic view of the main body of a dispensing device according to yet another embodiment of the present invention.
Figure 23:
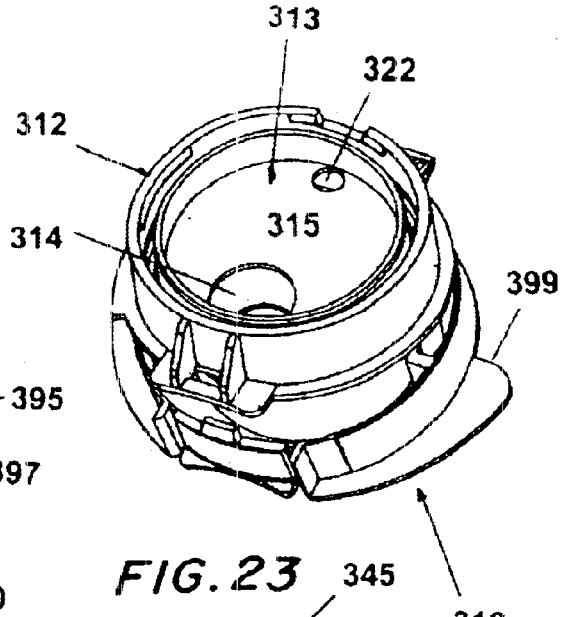
FIG. 23 is a schematic view of the main body shown in FIG. 22 from the other side.
Figure 24:
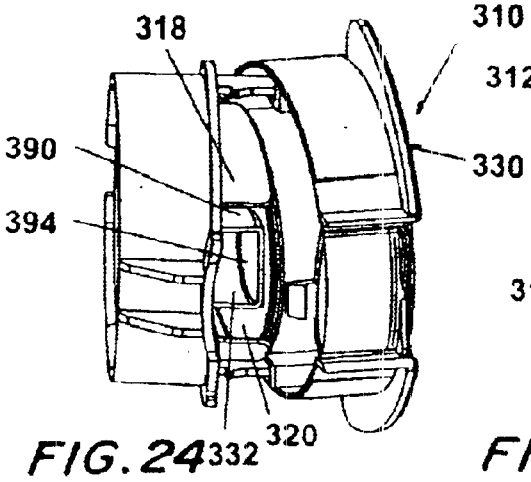
FIG. 24 is an underside view of the closure of the device shown in FIGS. 22 and 23.
Figure 25:
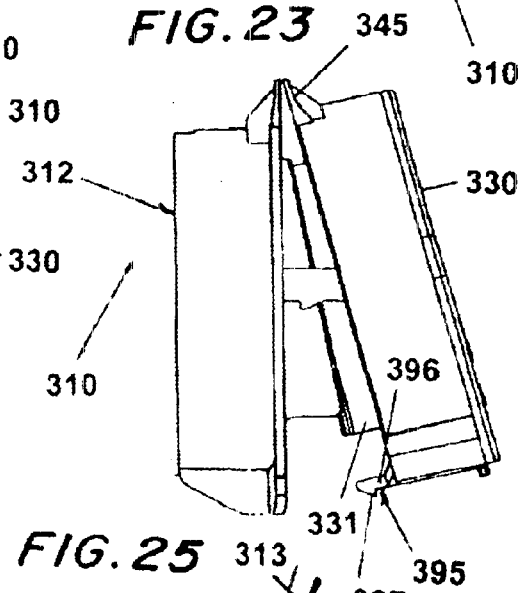
FIG. 25 is a side view of the closure device shown in FIGS. 22 to 24.
Figure 27:
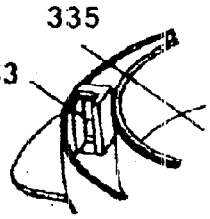
FIGS. 26 and 27 are detailed views of parts of the closure device shown in FIGS. 22 to 25.
Figure 26:
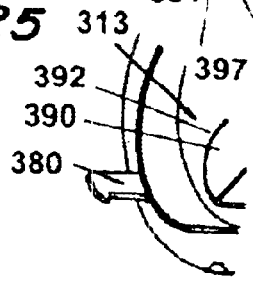

FIG. 11 shows a further embodiment of the device according to the present invention. In this embodiment the distance between the end wall 13 and the open end of the tubular side wall has been increased so that it is spaced from the closure 30 and the diameter of the main body 12 and the height of the end wall 13 increased.

In this embodiment the size of the air breather port 22 and the liquid transfer port 14 can be increased to give effect to an increase in the static head differential and an increase in the fluid flow through the liquid dispensing outlet 32.

Referring to FIGS. 12 to 20 of the drawings there is shown a dispensing device generally indicated at 210 which may be adapted to be fitted to a container (not shown) in a similar fashion described above.

The dispensing device 210 includes a main body portion 212 having an end wall 213 with an internal side 215 which faces the interior of the container and an external side 216. The main body 212 also includes a tubular side wall section 218 extending from the end wall 213 the space adjacent the end wall and bounded by parts of the wall of the tubular side wall section defining a chamber 220. A liquid transfer port 214 and a breather port 222 are formed in the end wall 213. The ports 214 and 222 are spaced apart so as to produce static head pressure differential therebetween.

The chamber 220 is disposed on the external side of the end wall of the main body 212 and receives therein liquid from the liquid transfer port 214. The device further includes a closure member 230 for opening and closing a dispensing outlet 232 which is in liquid communication with the chamber 220. The closure member 230 is adapted to close the dispensing outlet 232 as a result of pivotal movement relative to the main body portion 212. The closure member 230 includes a plug section 231 having an inner end face 235 which is receivable within the tubular section of the main body so as to enclose the chamber 220, the plug section 231 being movable so as to cause the dispensing outlet 232 to open and close. As shown the plug section 230 is hingedly connected to the main body at hinge 245. Gripping recesses 236 are provided for opening and closing the closure member. The plug section has sealing rings on its outer surface providing a seal against the inner surface of the tubular side wall section 218 of the main body 212.

A gutter wall 250 is provided which is an extension of the tubular section. The gutter wall 250 includes a lower most portion having the dispensing outlet 232 therein and two side wall portions which extend to each side of the outlet. As shown the gutter wall 250 is an extension of the tubular section, the side wall portions being tapered outwardly from a position near the top of the tubular section when it is in its normal operating orientation so that the gutter wall is at its widest in the region of lower most portion. The side wall portions are adapted to act as gutters directing fluid towards the discharge outlet 232.

As best seen in FIGS. 18 to 21, the device further includes a tamper evidence pin 286 which is adapted to co-operate with the ring 287 mounted on the closure via breakable strips 285, the end of the pin 286 being received through the ring and having a barbed section to inhibit withdrawal. The ring 287 is caused to break away when the closure member 230 is moved to the open position for the first time. The ring is retained on the pin when it is broken away from the plug section. Locating pins 288 and 289 limit the pivotal movement of the closure member. The locating pins each have a shoulder 295 and 296 thereon which co-operate with elements 297 and 298 in guide tubes 299 and 300. In the closed position, shoulders 295 and 296 abut against cooperating parts 305 on the outer side of the tubes. Secondary locking shoulders 308 abut against elements 297 and 298 in the closed position. The tubes 299 and 300 are oval in shape in order to provide some movement of the pins relative thereto as a result of the pivotal movement of the closure but also provided for a position guide action.

The device further includes a flow control member 290 which includes a curved side wall 292 and an end wall 294. The flow control member 290 is open on its underside. The curved side wall 292 which is generally semi-circular in cross section extends into the chamber 220 from external side 218 of the end wall 213 of the device and partially surrounds the liquid transport port 214. The end wall 294 is slightly inclined with respect to the side wall, 292 of the flow director 290.

In the closed position as shown the plug section 231 overlies the dispensing outlet 232. By finger manipulation of the gripping recesses 236 the closure 230 can be pulled outwardly thereby pivoting about hinge 245 so that the tubular section 231 is clear of the dispensing outlet 232. The closure is arranged for pivotal movement through about 15°. When the closure is opened air can enter the chamber 220 around the closure. Liquid immediately commences discharge from the chamber 220 through the dispensing outlet 232. Shortly after the outlet is opened liquid will flow from the container through the liquid transport port into the chamber and out through the dispensing outlet. The flow director 290 directs flow from the liquid transfer port towards the dispensing outlet. Other liquid in the chamber is guided around the curved side wall and then to the dispensing outlet. This arrangement minimises turbulence providing a continuous smooth flow from the dispensing outlet.

Referring to FIGS. 22 to 27 of the drawings there is shown a dispensing device generally indicated at 310 which is adapted to be fitted to a container (not shown) in a similar fashion to that described earlier.

The dispensing device 310 includes a main body portion 312 having an end wall 313 with an internal side 315 which faces the interior of the container and an external side. The main body 312 also includes a tubular side wall section 318 extending from the end wall 313 the space adjacent the end wall and bounded by parts of the wall of the tubular side wall section defining a chamber 320. A liquid transfer port 314 and a breather port 322 are formed in the end wall 313. The ports 314 and 322 are spaced apart so as to produce static head pressure differential therebetween.

The chamber 320 is disposed on the external side of the end wall of the main body 312 and receives therein liquid from the liquid transfer port 314. The device further includes a closure member 330 for opening and closing a dispensing outlet 332 which is in liquid communication with the chamber 320. The closure member 330 is adapted to close the dispensing outlet 332 as a result of pivotal movement relative to the main body portion 312. The closure member 330 includes a plug section 331 having an inner end face which is receivable within the tubular section of the main body so as to enclose the chamber 320, the plug section 331 being movable so as to open or close the dispensing outlet 332. As shown the plug section 331 is hingedly connected to the main body at hinge 345. The plug section has sealing rings on its outer surface providing a seal against the inner surface of the tubular side wall section 318 of the main body 312.

A gutter wall is provided which is an extension of the tubular section. The gutter wall includes a lower most portion having the dispensing outlet 332 therein and two side wall portions which extend to each side of the outlet. As shown the gutter wall is an extension of the tubular section, the side wall portions being tapered outwardly from a position near the top of the tubular section when it is in its normal operating orientation so that the gutter wall is at its widest in the region of the lowermost portion. The side wall portions are adapted to act as gutters directing fluid towards the discharge outlet 332.

The device further includes a flow control member 390 which includes a curved side wall 392 and an end wall 394. The flow control member 390 is open on its underside.

The curved side wall 392 which is generally semicircular in cross section extends into the chamber 320 from external side 318 of the end wall 313 of the device and partially surrounds the liquid transport port 314 The end wall 394 is slightly inclined with respect to the side wall 392 of the flow control member 390.

In the closed position as shown the plug section 331 overlies the dispensing outlet 332. When the closure is opened air can enter the chamber 320 around the closure. Liquid immediately commences discharge from the chamber 320 through the dispensing outlet 332. Shortly after the outlet is opened liquid will flow from the container through the liquid transport port into the chamber and out through the dispensing outlet. The flow control member 390 directs flow from the liquid transfer port towards the dispensing outlet. Other liquid in the chamber is guided around the curved side wall and then to the dispensing outlet. This arrangement minimises turbulence providing a continuous smooth flow from the dispensing outlet.

Movement of the closure relative to the main body is limited by two pins 380 which are located in respective recesses or guide tubes 383 on the closure. The pins 380 have a shoulder thereon which can engage against a stop in the recess or guide tube with which it is associated when in the open position to limit movement beyond that point.

The device further includes a safety catch 395 which includes a latch member 396 having a latch body and a locking lug 397 having a barb or projection at its free end. The latch body is formed integral with the closure member 330 but is deformable relative thereto. The closure member 330 further includes finger receiving edge portions 398 and 399. The arrangement is such that the closure member 330 can be gripped by placing the thumb of the operator hand against the latch body and two fingers of that hand on respective ones of edge portions 398 and 399. By the application of a force to the closure member 330 the latch body can be deformed. The locking lug and its barb or projection are arranged to cooperate with a detent 400 formed in the main body 312 of the device. In the locked position the barb or projection is held against the detent. By applying a force as described above the latch body is deformed thereby releasing the barb or projection from the detent and thereby permitting movement of the closure member into the open position.

Finally, it is to be understood that various alterations, modifications and/or additions may be incorporated into the various constructions and arrangements of parts without departing from the spirit or ambit of the invention.

We claim:

1. A dispensing device for dispensing liquid from a container, the dispensing device including a main body which includes an end wall having an internal side face directed towards the interior of the container and an external side face, a dispensing outlet, and a closure moveable relative to the main body between open and closed positions to selectively open and close the dispensing outlet, a chamber between the external side face and the dispensing outlet, a liquid transfer port in the main body for permitting liquid flow from the container interior to the chamber and a breather port in the main body providing communication between the container interior and the chamber, the liquid transfer port and the breather port being separate and spaced apart from the one another with the breather port being disposed above the liquid transfer port when in a dispensing orientation so as to form a static head pressure differential therebetween, the spacing between the breather port and the liquid transfer port together with the chamber being such as to provide for a continuous and controlled flow of liquid from the dispensing outlet.

2. A dispensing device according to claim 1 wherein the cross-sectional dimension of the liquid transfer port is greater than the cross-sectional dimension of the breather port.

3. A dispensing device according to claim 2 wherein said closure can close the open end of the tubular side wall.

4. A dispensing device according to claim 3 wherein said dispensing outlet is in said tubular side wall at a lower section thereof when in the dispensing orientation.

5. A dispensing device according to claim 1 where in the main body includes a generally tubular side wall extending from the external side face of the end wall, such that the end wall and at least part of the tubular side wall define the chamber.

6. A dispensing device according to claim 1 wherein said closure is pivotally connected to the main body for movement between the open and closed positions.

7. A dispensing device according to claim 6 wherein including one or more pins on one of either the main body or closure arranged to cooperate with respective one or more guides on the other either the main body or closure to guide on the closure during pivotal movement thereof.

8. A dispensing device according to claim 1 including flow control members which form a zone within the chamber containing the liquid transfer port and breather port.

9. A dispensing device according to claim 8 wherein said flow control members include two generally parallel spaced apart partition walls which project from the closure and are receivable in slots in the end wall of the main body.

10. A dispensing device according to claim 1 further including a flow control member associated with the liquid transfer port, the flow control member extending into the chamber and includes a wall adjacent to and above the liquid transfer port in the dispensing orientation.

11. A device according to claim 1, further including a safety catch operable to releasably retain the closure in the closed position.

12. A device according to claim 11, wherein the safety catch includes a resilient latch member on one of the closure or the main body adapted to cooperate with a detent on the other of the closure or the main body, the arrangement being such deformation of the latch member causes it to release from the detent.

13. A dispensing device for dispensing liquid from a container, the dispensing device including a main body which includes an end wall having an internal side face directed towards the interior of the container and an external side face, a dispensing outlet, and a closure moveable relative to the main body between open and closed positions to selectively open and close the dispensing outlet, a chamber between the external side face and the dispensing outlet, a liquid transfer port in the main body for permitting liquid flow from the container interior to the chamber and a breather port in the main body providing communication between the container interior and the chamber, the liquid transfer port and the breather port being separate and spaced apart from one another with the breather port being disposed above the liquid transfer port when in a dispensing orientation so as to form a static head pressure differential therebetween, the spacing between the breather port and the liquid transfer port together with the chamber being such as to provide for a continuous and controlled flow of liquid from the dispensing outlet, the cross-sectional dimension of the liquid transfer port being greater than the cross-sectional dimension of the breather port said closure closing the open end of the tubular side wall, said dispensing outlet is in said tubular side wall at a lower section thereof when in the dispensing orientation, said tubular wall extending in the region of the dispensing outlet so as to form a gutter which directs liquid within the chamber towards the dispensing outlet.

14. A dispensing device for dispensing liquid from a container, the dispensing device including a main body which includes an end wall having an internal side face directed towards the interior of the container and an external side face, a dispensing outlet, and a closure moveable relative to the main body between open and closed positions to selectively open and close the dispensing outlet, a chamber between the external side face and the dispensing outlet, a liquid transfer port in the main body for permitting liquid flow from the container interior to the chamber and a breather port in the main body providing communication between the container interior and the chamber, the liquid transfer port and the breather port being separate and spaced apart from one another with the breather port being disposed above the liquid transfer port when in a dispensing orientation so as to form a static head pressure differential therebetween, the spacing between the breather port and the liquid transfer port together with the chamber being such as to provide for a continuous and controlled flow of liquid from the dispensing outlet, the device further including a flow control member associated with the liquid transfer port, the flow control member extending into the chamber and including a curved side wall adjacent to and above the liquid transfer port in the dispensing orientation which is generally semi-circular in shape and an end wall, the curved side wall extending from the end wall of the dispensing device and overlies the liquid transfer port, the side wall being open at its underside which faces towards the dispensing outlet.

15. A dispensing device according to claim 14, further including means for limiting the pivotal movement of the closure relative to the main body of the device between the open and closed positions of the dispensing outlet, the limiting means including a pair of pins, each pin having a catching section, which engages with an abutment which defines a travel limit stop.

* * * * *